US010440461B2

(12) United States Patent
Reynolds et al.

(10) Patent No.: US 10,440,461 B2
(45) Date of Patent: Oct. 8, 2019

(54) DYNAMICALLY REACTIVE, FORMABLE AND WEARABLE EARPIECE

(71) Applicants: Intel Corporation, Santa Clara, CA (US); Derek J. Reynolds, El Dorado Hills, CA (US); Aleksander Magi, Portland, OR (US)

(72) Inventors: Derek J. Reynolds, El Dorado Hills, CA (US); Aleksander Magi, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/762,947

(22) PCT Filed: Sep. 25, 2015

(86) PCT No.: PCT/US2015/052442
§ 371 (c)(1),
(2) Date: Mar. 23, 2018

(87) PCT Pub. No.: WO2017/052639
PCT Pub. Date: Mar. 30, 2017

(65) Prior Publication Data

US 2018/0279034 A1 Sep. 27, 2018

(51) Int. Cl.
*H04R 1/10* (2006.01)
*H04R 1/02* (2006.01)

(52) U.S. Cl.
CPC ..... *H04R 1/1041* (2013.01); *H04R 1/105* (2013.01); *H04R 1/02* (2013.01); *H04R 1/1016* (2013.01);
(Continued)

(58) Field of Classification Search
CPC ..... H04R 1/1041; H04R 1/105; H04R 1/02; H04R 1/1016; H04R 1/1091; H04R 2420/07; H04R 2460/17
(Continued)

(56) References Cited

U.S. PATENT DOCUMENTS 8,374,367 B2 * 2/2013 Nielsen ..... H04R 25/658 381/313
2004/0258263 A1 12/2004 Saxton et al.
(Continued)

FOREIGN PATENT DOCUMENTS

KR 1020080107498 A 12/2008
KR 2020100000504 U 1/2010
(Continued)

OTHER PUBLICATIONS

Travis Deyle, "Electroactive Polymers (EAP) as Artificial Muscles (EPAM) for Robot Applications", Hizook, Dec. 28, 2009, 8 pages.
(Continued)

*Primary Examiner* — William A Jerez Lora
(74) *Attorney, Agent, or Firm* — Jordan IP Law, LLC

(57) ABSTRACT

Systems, apparatuses and methods may provide for an earpiece that includes an audio subsystem and a longitudinal housing that is bendable between a substantially straight shape and a substantially curved shape. The longitudinal housing may contain the audio subsystem and include a flexible material. Additionally, a speaker may be coupled to the audio subsystem and positioned at an end of the longitudinal housing. In one example, the earpiece also includes a controller coupled to the flexible material, wherein the controller generates one or more control signals that cause the flexible material to automatically complete a bend of the longitudinal housing to the substantially curved shape.

20 Claims, 6 Drawing Sheets

(52) U.S. Cl.
CPC ..... *H04R 1/1091* (2013.01); *H04R 2420/07* (2013.01); *H04R 2460/17* (2013.01)

(58) Field of Classification Search
USPC ..... 381/74
See application file for complete search history.

(56) References Cited

U.S. PATENT DOCUMENTS

| | | | | |
|---|---|---|---|---|
| 2007/0280496 | A1* | 12/2007 | Karamuk | H04R 25/656 381/328 |
| 2008/0101644 | A1* | 5/2008 | Yau | H04R 1/083 381/380 |
| 2014/0080553 | A1 | 3/2014 | Torset et al. | |
| 2014/0153768 | A1* | 6/2014 | Hagen | H04R 1/1008 381/380 |
| 2016/0052259 | A1* | 2/2016 | Sugitani | B41J 2/18 347/17 |

FOREIGN PATENT DOCUMENTS

| | | | |
|---|---|---|---|
| KR | 101482547 | * | 1/2013 |
| KR | 101482547 B1 | | 1/2015 |

OTHER PUBLICATIONS

Amandaghassaei, "Arduino, Sensors, and MIDI", Instructables, 2015, 4 pages.

International Search Report and Written Opinion for International Patent Application No. PCT/US2015/052442, dated Jun. 27, 2016, 13 pages.

International Preliminary Report on Patentability for International Patent Application No. PCT/US2015/052442, dated Apr. 5, 2018, 10 pages.

* cited by examiner

DYNAMICALLY REACTIVE, FORMABLE AND WEARABLE EARPIECE

CROSS REFERENCE TO RELATED APPLICATIONS

This application is a U.S. National Phase Patent Application which claims benefit to International Patent Application No. PCT/US2015/052442 filed on Sep. 25, 2015.

TECHNICAL FIELD

Embodiments generally relate to headsets and/or earpieces. More particularly, embodiments relate to dynamically reactive, formable and wearable earpieces.

BACKGROUND

Mobile devices such as mobile phones and smart tablets may transfer (e.g., input and/or output) audible content such as music, call audio, and so forth, wherein users of the mobile devices may wear in-ear audio pieces (e.g., earpieces, earbuds) in order to hear and/or produce the content. Many of these earpieces may not fit the user comfortably or securely because they are too large, too small, have protrusions, etc. The poor fit may lead to suboptimal sound quality. Moreover, conventional earpieces may be awkwardly stored, difficult to find (e.g., if in a bag or pocket) and/or easily damaged.

BRIEF DESCRIPTION OF THE DRAWINGS

The various advantages of the embodiments will become apparent to one skilled in the art by reading the following specification and appended claims, and by referencing the following drawings, in which:

DESCRIPTION OF EMBODIMENTS

Figure 1A:
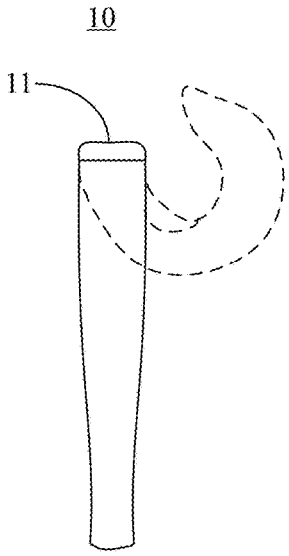
FIGS. 1A and 1B are illustrations of an example of an earpiece in a substantially straight shape and a substantially curved shape, respectively, according to an embodiment.
Figure 1B:
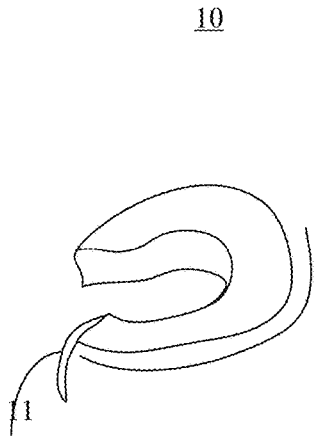

Turning now to FIG. 1A, a wearable earpiece 10 is shown in a substantially straight shape. As will be discussed in greater detail, the housing of the earpiece 10 may generally include a longitudinal profile and a flexible material that enables the earpiece 10 to be bent/formed from the substantially straight shape shown in FIG. 1A to a substantially curved shape as shown in FIG. 1B. The ability to bend the earpiece 10 as illustrated enables the earpiece 10 to provide significant advantages with respect to the storage of the earpiece 10 as well as the wearing of the earpiece. For example, while in the substantially straight shape of FIG. 1A, the earpiece may be stowed in, attached to or otherwise mated with a corresponding recess of a nearby device (not shown) such as a smart tablet, mobile phone or other device. While in the substantially curved shape of FIG. 1B, on the other hand, the earpiece 10 may fit comfortably into the outer ear of a user (e.g., wearer, individual). The transition between the substantially straight shape and the substantially curved shape may be performed, in its entirety or in part, manually by the user or automatically by the earpiece 10 itself.

Figure 2:
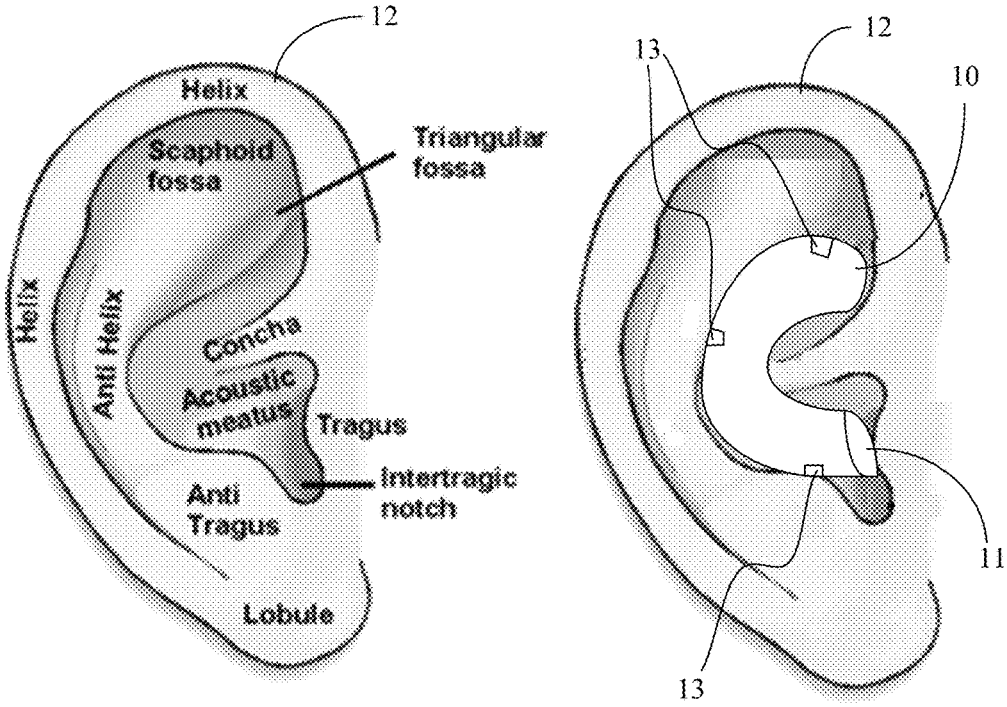
FIG. 2 is an illustration of an example of an ear structure and an earpiece while being worn according to an embodiment.

FIG. 2 shows the structure of an outer ear 12 and the earpiece 10 while inserted into the outer ear 12 (e.g., in the triangular fossa, anti-helix and acoustic meatus regions) of a user. The earpiece 10 may include a speaker 11 positioned at an end of the longitudinal housing in order to deliver sound to the ear canal and one or more pressure sensors 13 to measure the amount of contact with the outer ear 12.

Figures 3A, 3B, 3C:
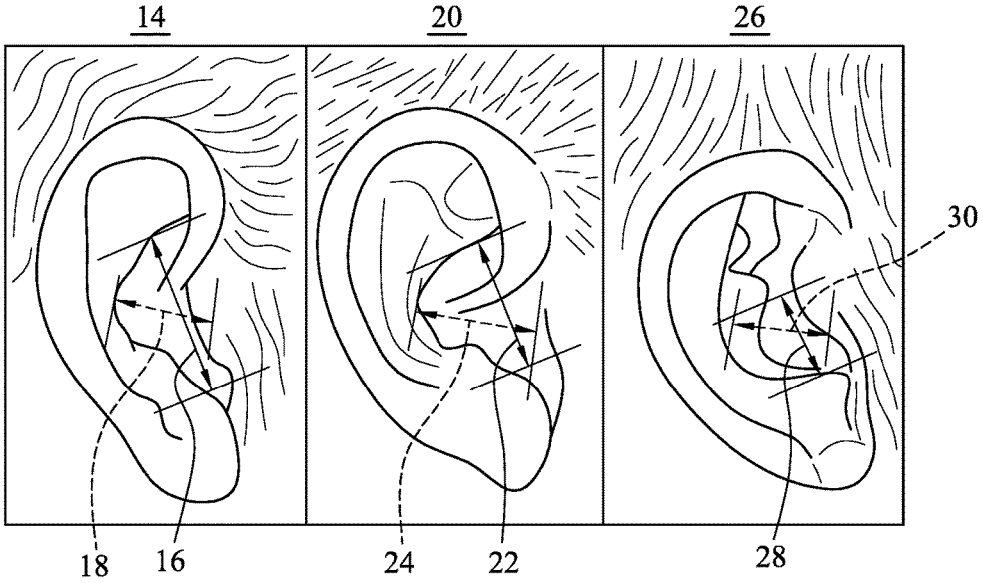
FIGS. 3A-3C are illustrations of examples of different ear structures according to an embodiment.

FIGS. 3A-3B show examples of different ear structures. For example, in FIG. 3A a first individual 14 has a relatively long acoustic meatus to triangular fossa distance 16 and a relatively short anti-helix to tragus distance 18. In FIG. 3B, a second individual 20 has a medium acoustic meatus to triangular fossa distance 22 and a medium anti-helix to tragus distance 24. Additionally, FIG. 3C demonstrates that a third individual 26 may have a relatively short acoustic meatus to triangular fossa distance 28 and a relatively short anti-helix to tragus distance 30. Thus, the flexible material of an earpiece such as the earpiece 10 (FIGS. 1A-1B and 2) may enable each of the individuals 14, 20, 26 to obtain the optimal curvature of the earpiece in terms of comfort and secureness.

Figure 4A:
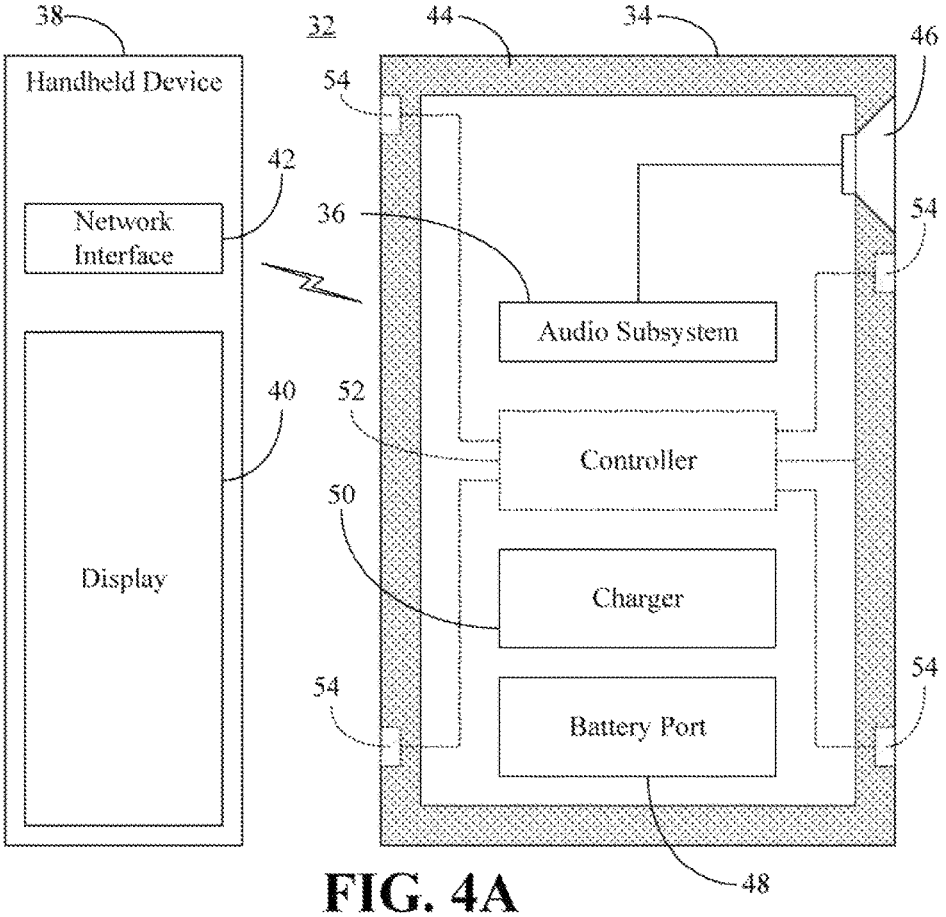
FIGS. 4A-4C are block diagrams of examples of systems according to an embodiment.

Turning now to FIG. 4A, a system 32 is shown in which an earpiece 34 includes an audio subsystem 36 that is coupled to a speaker 46 and receives an audio signal from a handheld device 38 (e.g., smart tablet, convertible tablet, mobile phone, mobile Internet device/MID, personal digital assistant/PDA, media player, etc.) having a display 40 and a network interface 42 (e.g., Bluetooth, Institute of Electrical and Electronics Engineers/IEEE 802.15.1-2005, Wireless Personal Area Networks). Thus, the earpiece 34 may be used to listen to audio (e.g., music, talk radio) delivered by the handheld device 38, participate in phone calls conducted on the handheld device 38, and so forth. The earpiece 34 may be readily substituted for the earpiece 10 (FIGS. 1A-1B, 2), already discussed. Accordingly, the earpiece 34 may include a generally longitudinal housing that is bendable between a substantially straight shape that fits within a recess (not shown) in the handheld device 38 and a substantially curved shape that facilitates placement of the earpiece 34 into the outer ear of a user.

In the illustrated example, the housing contains the audio subsystem 36 and includes a flexible material 44 such as, for example, a shape memory alloy (e.g., muscle wire), an electroactive polymer (EAP), an electromechanical bladder, and so forth. In the case of the shape memory alloy, the user may bend the earpiece 34 into the substantially curved shape so that it remains in the curved shape and fits comfortably within the ear of the user. Upon removal of the earpiece 34 from the ear, the user may straighten the earpiece 34 back to the substantially straight shape and, optionally, stow the earpiece 34 within the handheld device 38. The illustrated earpiece 34 also includes a battery port 48 to receive power (e.g., from a battery) and a charger 50 to supply power (e.g., wirelessly or via contacts) to the battery port 48 while the earpiece 34 is mated with the handheld device 38.

In another example, the earpiece 34 also includes a controller 52 coupled to the flexible material 44, wherein the controller 52 may generate one or more control signals that cause the flexible material 44 to complete bends of the longitudinal housing to the substantially curved shape. Thus, if the flexible material 44 is an EAP, the electrical potential of the control signals may cause the polymer particles to shift and deform the earpiece 34 into the appropriate shape. The control signals may be generated based on schedule data, context data, and so forth. For example, the schedule data might be used to generate the control signals on a periodic or continuous basis to ensure that the earpiece 34 does not become dislodged over time (e.g., during exercise). In this regard, the context data may indicate the current usage model such as, for example, more active (e.g., jogging), less active (e.g., stationary), and so forth.

For example, the context data might be obtained from one or more motion sensors (not shown) or other sensors (e.g., ambient light sensors, magnetometers, etc.) that determine the level of activity of the user, wherein the activity level may be used to alter the frequency with which the controller 52 adjusts the fit (e.g., relatively high frequency when the user is more active, relatively low frequency when the user is less active, etc.). The context and/or schedule data may also be user-specific. Thus, more frequent adjustments may be appropriate for one user given historical performance, while less frequent adjustments may be suitable for another user given historical performance.

Additionally, the controller 52 may generate the control signals in response to a manual trigger that corresponds to, for example, detachment, of the earpiece 34 from the handheld device 38. The manual trigger may be, for example, the opening or closing of a switch (not shown) positioned at a physical interface between the earpiece 34 and the device 38, the pressing of a button on the exterior of the earpiece 34, and so forth. Thus, the controller 52 may automatically manage the bend from the substantially straight shape to the substantially curved shape. Alternatively, the user may manually conduct a "coarse" bend of the earpiece 34, with the controller 52 making "fine" adjustments of the profile to obtain the optimal curved shape in terms of comfort and secureness.

The illustrated earpiece 34 also includes a plurality of pressure sensors 54 that generate feedback signals based on the contact being made between the earpiece 34 and its surroundings (e.g., the user's ear). Accordingly, the controller 52 may discontinue generation of the control signals when the feedback signals from the pressure sensors 54 exceed one or more thresholds. For example, one pressure sensor 54 might generate an increased feedback signal intensity (e.g., that exceeds a particular threshold, which may be user-specific and/or configurable, based on historical data, and so forth) in response to contact being made with the triangular fossa, while another pressure sensor 54 may generate an increased feedback signal intensity (e.g., that exceeds another threshold, which may also be user-specific and/or configurable, based on historical data, and so forth) in response to contact being made with the acoustic meatus. When the controller 52 determines that an appropriate level of contact is being made, the controller 52 may halt the automated bend of the earpiece 34.

The controller 52 may also initiate a transition of the longitudinal housing from the substantially curved shape to the substantially straight shape in response to, for example, a manual trigger that corresponds to removal of the earpiece 34 from an ear. Thus, the controller 52 might detect, via the pressure sensors 54 or other suitable button, that the user has pulled the earpiece from the ear. The controller 52 may distinguish between the earpiece 34 being pulled from the ear and the earpiece 34 falling from the ear on the basis of, for example, the user touching one or more of the pressure sensors 54 prior to detection of the earpiece 34 no longer being in contact with the ear.

Figure 4B:
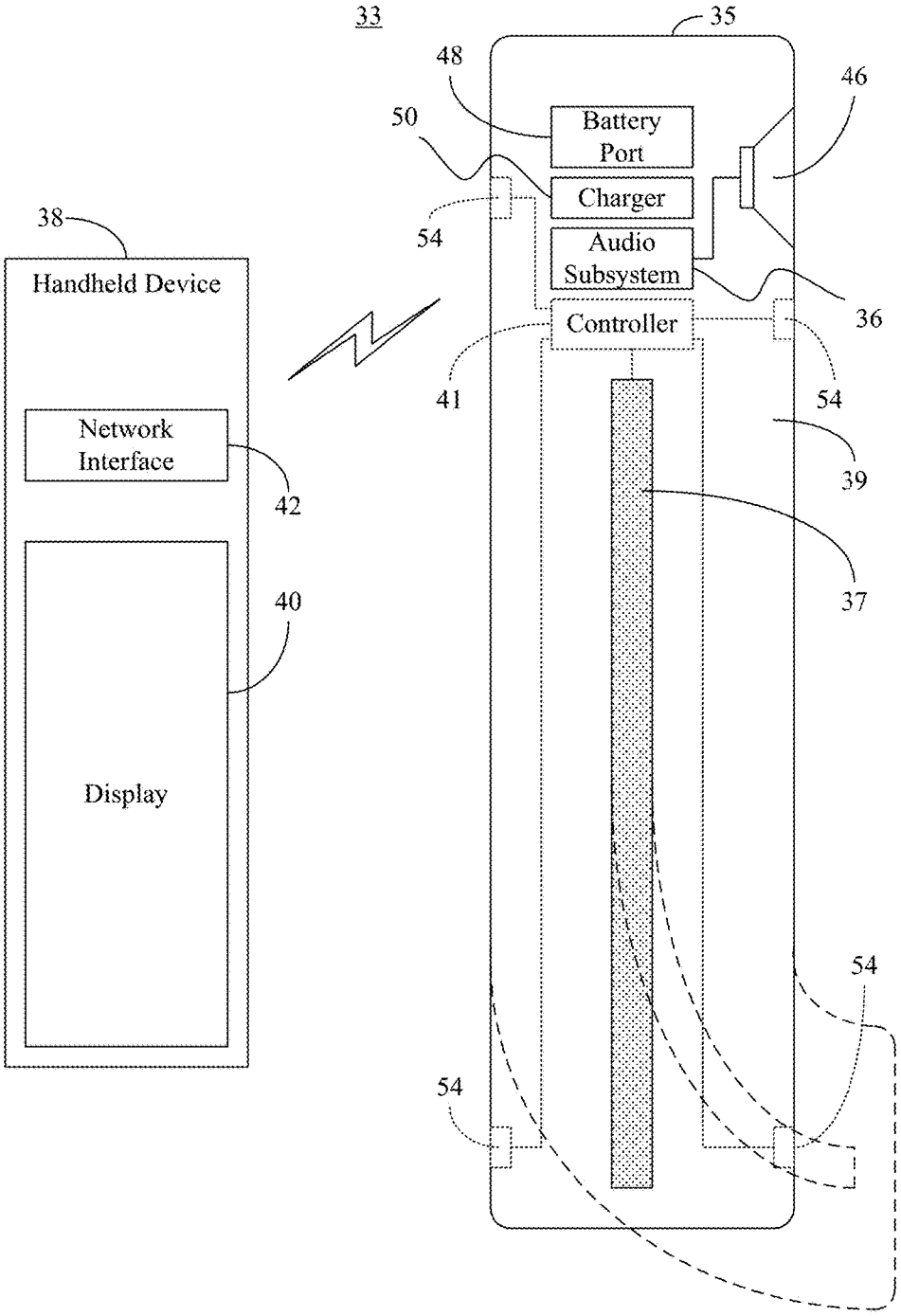

FIG. 4B shows another system 33 in which an earpiece 35 includes a flexible material 37 that is substantially encompassed by an outer shell 39 such as, for example, elastic silicon, foam or other material that provides cushioning to the skin of the wearer while protecting the interior components of the earpiece 35. Thus, the flexible material 37 might include muscle wire that is either manually transformed into a substantially curved shape (shown in longer dashed lines) or automatically transformed into the substantially curved shape by a controller 41, in the illustrated example.

Figure 4C:
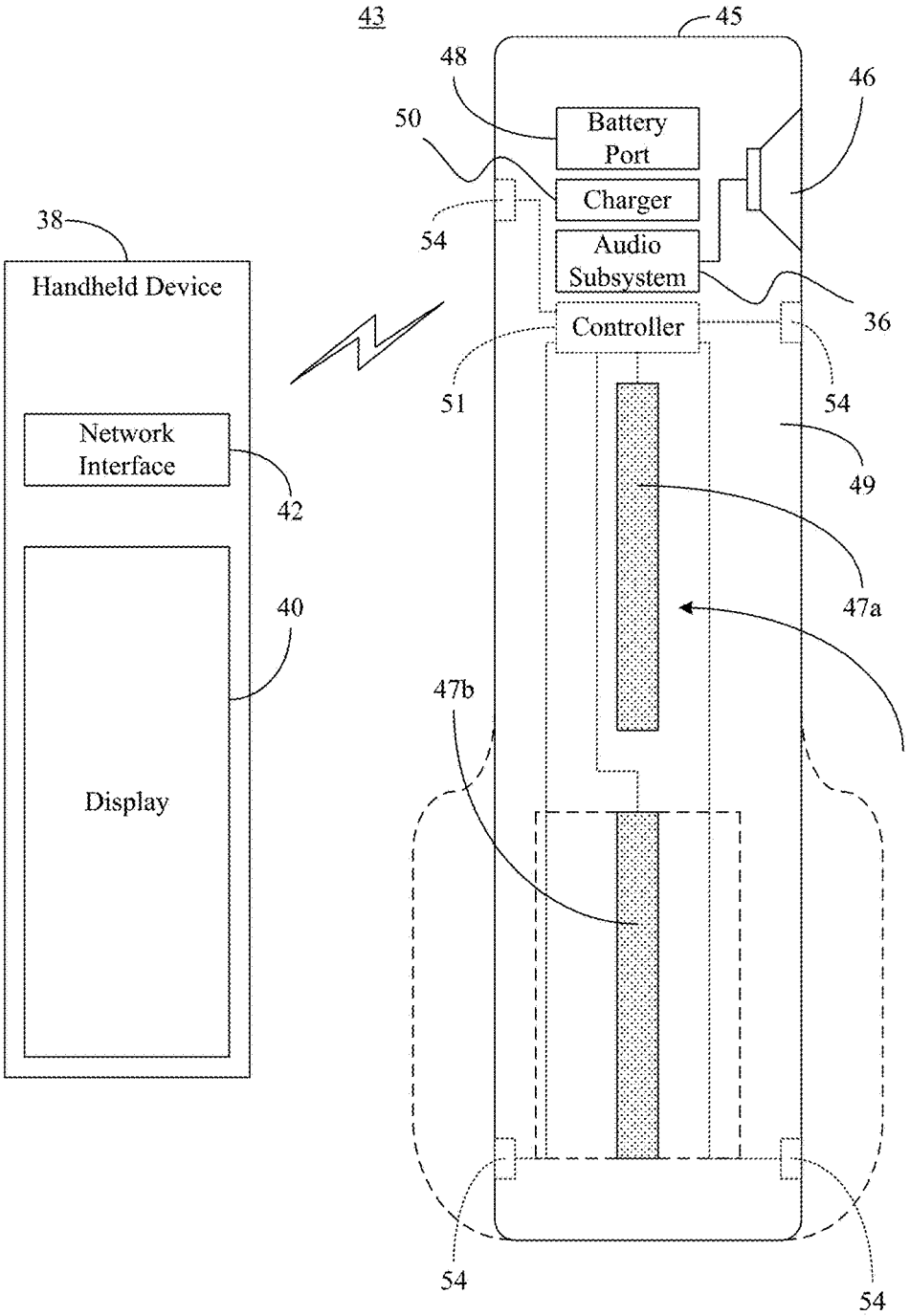

Additionally, FIG. 4C shows a system 43 in which an earpiece 45 includes a flexible material 47 (47*a*, 47*b*) that is encompassed by an outer shell 49 and partitioned into multiple sections that are individually adjustable by a controller 51. In the illustrated example, a first material section 47*a* remains deactivated, while a second material section 47*b* is an electromechanical bladder that is activated by the controller 51. The activation may cause the second material section 47*b* to expand in a manner that forms the earpiece 45 into the substantially curved shape.

Figure 5:
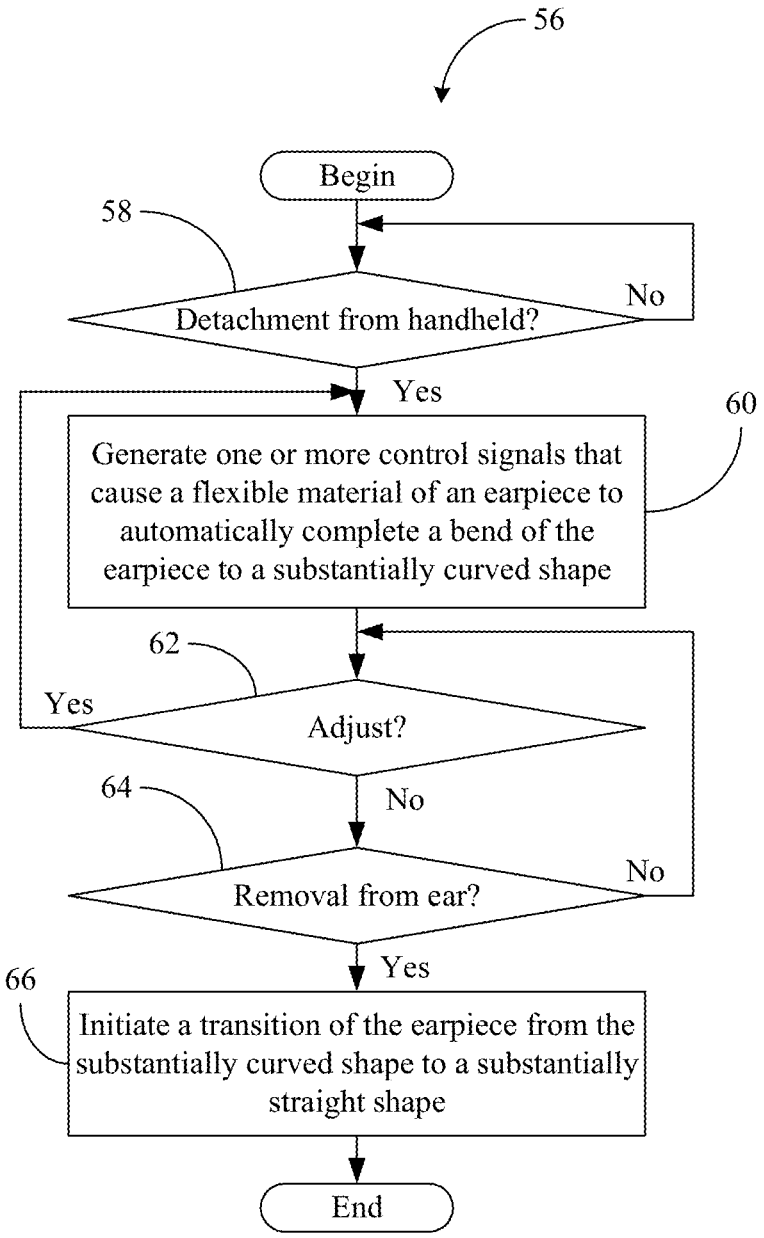
FIG. 5 is a flowchart of an example of a method of operating an earpiece according to an embodiment.

FIG. 5 shows a method 56 of operating an earpiece. The method 56 may generally be implemented in a controller such as, for example, the controller 52 (FIG. 4), already discussed. More particularly, the method 56 may be implemented as one or more modules in a set of logic instructions stored in a machine- or computer-readable storage medium such as random access memory (RAM), read only memory (ROM), programmable ROM (PROM), firmware, flash memory, etc., in configurable logic such as, for example, programmable logic arrays (PLAs), field programmable gate arrays (FPGAs), complex programmable logic devices (CPLDs), in fixed-functionality hardware logic using circuit technology such as, for example, application specific integrated circuit (ASIC), complementary metal oxide semiconductor (CMOS) or transistor-transistor logic (TTL) technology, or any combination thereof.

Illustrated block 58 determines (e.g., based on a manual trigger) whether the earpiece has been detached from a handheld device. If so, block 60 generates, in response to the detachment of the earpiece, one or more control signals that cause a flexible material of the earpiece to automatically complete a bend of the earpiece to a substantially curved shape. As already noted, the control signals may be generated based on schedule data, context data, etc., or any combination thereof. Moreover, the generation of the control signals may be discontinued at block 60 based on one or more feedback signals from one or more pressure sensors of the earpiece.

A determination may be made at block 62 as to whether an adjustment of the curvature of the earpiece is appropriate. Block 62 may also take into consideration the pressure sensor feedback signals, which might indicate that the earpiece has or will become partially dislodged from the ear. If adjustment is appropriate, the illustrated method 56 repeats block 60. Accordingly, the earpiece may be dynamically reactive to real-time changes in the fit with the user's ear. If adjustment is not appropriate, a determination may be made at block 64 as to whether the user has removed the earpiece from the ear. If so, illustrated block 66 initiates a transition of the earpiece from the substantially curved shape to a substantially straight shape. If removal has not been detected, the illustrated method 56 repeats the determination at block 62.

Figure 6A:
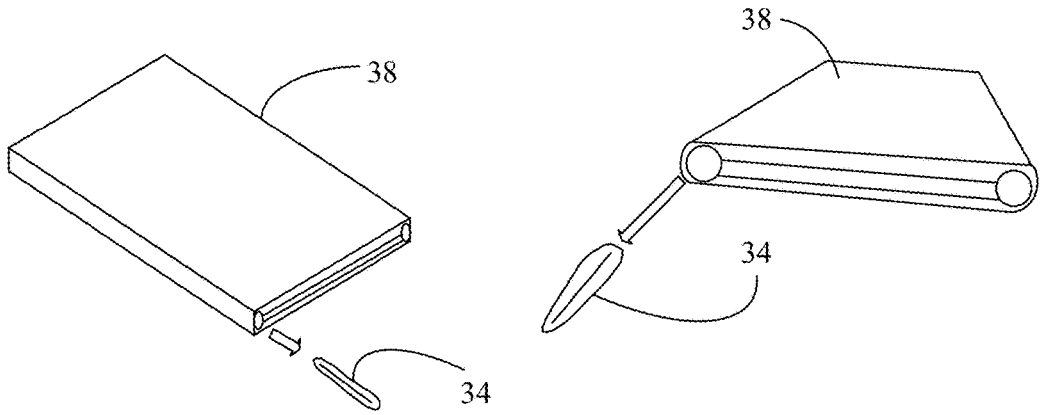
FIGS. 6A-6B are perspective and plan views, respectively, of an example of a system according to an embodiment.
Figure 6B:
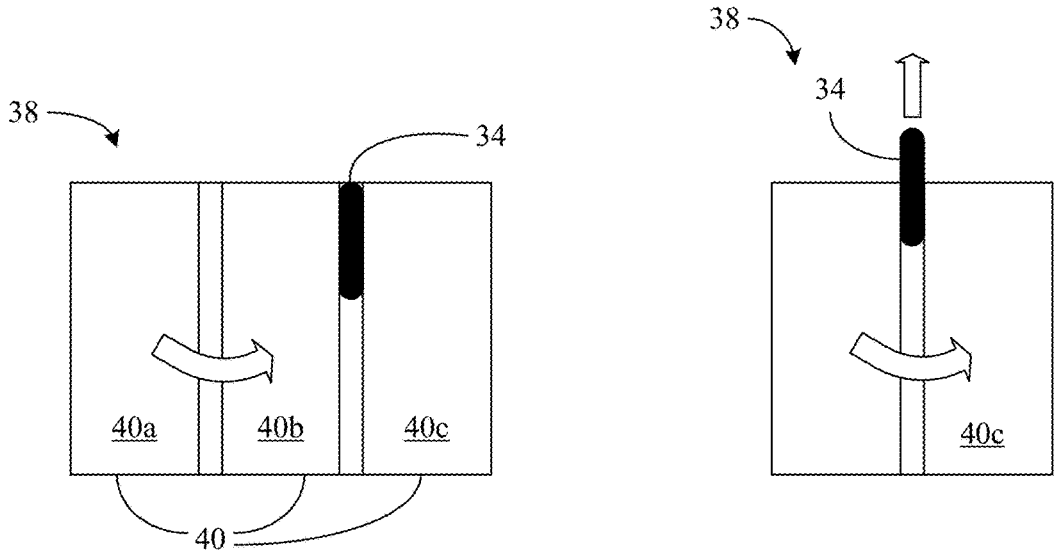

FIGS. 6A and 6B show various views of the handheld device 38 and the earpiece 34 in the substantially straight shape. In the illustrated example, the device 38 includes a foldable display 40 (40*a*-40*c*, e.g., tri-fold) having surfaces that define a recess 68. The substantially straight shape of the earpiece 34 may fit snugly within the recess 68 for storage, charging and/or protection. A first portion 40*a* of the display 40 may be folded onto a second portion 40*b* of the display 40, and the first and second portions 40*a*, 40*b* may be folded onto a third portion 40*c* of the display 40 in order to "clamp" the earpiece 34 into the recess 68. As best shown in FIG. 6A, the earpiece 34 may be removed from the device 38 without unfolding the display 40.

Additional Notes and Examples

Example 1 may include a communications system comprising a handheld device including a display, a network interface and one or more surfaces defining a recess, the handheld device to generate an audio signal via the network interface and an earpiece including an audio subsystem to receive the audio signal from the handheld device, a longitudinal housing that is bendable between a substantially straight shape that fits within the recess and a substantially curved shape, wherein the longitudinal housing contains the audio subsystem and includes a flexible material, and a speaker coupled to the audio subsystem and positioned at an end of the longitudinal housing.

Example 2 may include the system of Example 1, wherein the earpiece further includes a controller coupled to the flexible material, the controller to generate one or more control signals that cause the flexible material to complete a bend of the longitudinal housing to the substantially curved shape.

Example 3 may include the system of Example 2, wherein the controller is to generate the one or more control signals based on one or more of schedule data or context data.

Example 4 may include the system of Example 2, wherein the controller is to generate the one or more control signals in response to a manual trigger that corresponds to detachment of the earpiece from the handheld device.

Example 5 may include the system of Example 2, wherein the earpiece further includes one or more pressure sensors to generate one or more feedback signals, and wherein the controller is to discontinue generation of the one or more control signals based on the one or more feedback signals.

Example 6 may include the system of Example 2, wherein the controller is to initiate a transition of the longitudinal housing from the substantially curved shape to the substantially straight shape in response to a manual trigger that corresponds to removal of the earpiece from an ear.

Example 7 may include the system of Example 1, wherein the earpiece further includes a battery port to receive power, and a charger to supply power to the battery port.

Example 8 may include the system of any one of Examples 1 to 7, wherein the flexible material includes one or more of a shape memory alloy, an electroactive polymer or an electromechanical bladder.

Example 9 may include an earpiece comprising an audio subsystem, a longitudinal housing that is bendable between a substantially straight shape and a substantially curved shape, wherein the longitudinal housing contains the audio subsystem and includes a flexible material, and a speaker coupled to the audio subsystem and positioned at an end of the longitudinal housing.

Example 10 may include the earpiece of Example 9, further including a controller coupled to the flexible material, the controller to generate one or more control signals that cause the flexible material to automatically complete a bend of the longitudinal housing to the substantially curved shape.

Example 11 may include the earpiece of Example 10, wherein the controller is to generate the one or more control signals based on one or more of schedule data or context data.

Example 12 may include the earpiece of Example 10, wherein the controller is to generate the one or more control signals in response to a manual trigger that corresponds to detachment of the earpiece from a handheld device.

Example 13 may include the earpiece of Example 10, further including one or more pressure sensors to generate one or more feedback signals, wherein the controller is to discontinue generation of the one or more control signals based on the one or more feedback signals.

Example 14 may include the earpiece of Example 10, wherein the controller is to initiate a transition of the longitudinal housing from the substantially curved shape to the substantially straight shape in response to a manual trigger that corresponds to removal of the earpiece from an ear.

Example 15 may include the earpiece of Example 9, further including a battery port to receive power, and a charger to supply power to the battery port.

Example 16 may include the earpiece of any one of Examples 9 to 15, wherein the flexible material includes one or more of a shape memory alloy, an electroactive polymer or an electromechanical bladder.

Example 17 may include a method of operating an earpiece, comprising generating, in response to a first manual trigger that corresponds to detachment of the earpiece from a handheld device, one or more control signals that cause a flexible material of the earpiece to automatically complete a bend of the earpiece to a substantially curved shape, and initiate a transition of the earpiece from the substantially curved shape to a substantially straight shape in response to a second manual trigger that corresponds to a removal of the earpiece from an ear.

Example 18 may include the method of Example 17, wherein the one or more control signals are generated based on one or more of schedule data or context data.

Example 19 may include the method of any one of Examples 17 or 18, further including discontinuing generation of the one or more control signals based on one or more feedback signals from one or more pressure sensors of the earpiece.

Example 20 may include at least one non-transitory computer readable storage medium comprising a set of instructions, which when executed by an earpiece, cause the earpiece to generate, in response to a first manual trigger that corresponds to detachment of the earpiece from a handheld device, one or more control signals that cause a flexible material of the earpiece to automatically complete a bend of the earpiece to a substantially curved shape, and initiate a transition of the earpiece from the substantially curved shape to a substantially straight shape in response to a second manual trigger that corresponds to removal of the earpiece from an ear.

Example 21 may include the at least one non-transitory computer readable storage medium of Example 20, wherein the one or more control signals are to be generated based on one or more of schedule data or context data.

Example 22 may include the at least one non-transitory computer readable storage medium of any one of Examples 20 or 21, wherein the instructions, when executed, cause the earpiece to discontinue generation of the one or more control signals based on one or more feedback signals from one or more pressure sensors of the earpiece.

Example 23 may include an earpiece comprising means for generating, in response to a first manual trigger that corresponds to detachment of an earpiece from a handheld device, one or more control signals that cause a flexible material of the earpiece to automatically complete a bend of the earpiece to a substantially curved shape, and means for initiating a transition of the earpiece from the substantially curved shape to the substantially straight shape in response to a second manual trigger that corresponds to removal of the earpiece from an ear.

Example 24 may include the earpiece of Example 23, wherein the one or more control signals are to be generated based on one or more of schedule data or context data.

Example 25 may include the earpiece of any one of Examples 23 or 24, further including means for discontinuing generation of the one or more control signals based on one or more feedback signals from one or more pressure sensors of the earpiece.

Thus, techniques described herein may enable a more comfortable and secure fit for dynamically reactive and formable earpieces and, as a result, may enhance sound quality. Additionally, the techniques may enable more efficient storage of earpieces, while making them easier to find and keeping them protected from damage.

Embodiments are applicable for use with all types of semiconductor integrated circuit ("IC") chips. Examples of these IC chips include but are not limited to processors, controllers, chipset components, programmable logic arrays (PLAs), memory chips, network chips, systems on chip (SoCs), SSD/NAND controller ASICs, and the like. In addition, in some of the drawings, signal conductor lines are represented with lines. Some may be different, to indicate more constituent signal paths, have a number label, to indicate a number of constituent signal paths, and/or have arrows at one or more ends, to indicate primary information flow direction. This, however, should not be construed in a limiting manner. Rather, such added detail may be used in connection with one or more exemplary embodiments to facilitate easier understanding of a circuit. Any represented signal lines, whether or not having additional information, may actually comprise one or more signals that may travel in multiple directions and may be implemented with any suitable type of signal scheme, e.g., digital or analog lines implemented with differential pairs, optical fiber lines, and/or single-ended lines.

Example sizes/models/values/ranges may have been given, although embodiments are not limited to the same. As manufacturing techniques (e.g., photolithography) mature over time, it is expected that devices of smaller size could be manufactured. In addition, well known power/ground connections to IC chips and other components may or may not be shown within the figures, for simplicity of illustration and discussion, and so as not to obscure certain aspects of the embodiments. Further, arrangements may be shown in block diagram form in order to avoid obscuring embodiments, and also in view of the fact that specifics with respect to implementation of such block diagram arrangements are highly dependent upon the platform within which the embodiment is to be implemented, i.e., such specifics should be well within purview of one skilled in the art. Where specific details (e.g., circuits) are set forth in order to describe example embodiments, it should be apparent to one skilled in the art that embodiments can be practiced without, or with variation of, these specific details. The description is thus to be regarded as illustrative instead of limiting.

The term "coupled" may be used herein to refer to any type of relationship, direct or indirect, between the components in question, and may apply to electrical, mechanical, fluid, optical, electromagnetic, electromechanical or other connections. In addition, the terms "first", "second", etc. may be used herein only to facilitate discussion, and carry no particular temporal or chronological significance unless otherwise indicated.

As used in this application and in the claims, a list of items joined by the term "one or more of" may mean any combination of the listed terms. For example, the phrases "one or more of A, B or C" may mean A, B, C; A and B; A and C; B and C; or A, B and C.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

We claim:

1. A system comprising:

a handheld device including a display, a network interface and one or more surfaces defining a recess, the handheld device to generate an audio signal via the network interface; and an earpiece including, an audio subsystem to receive the audio signal from the handheld device, a longitudinal housing that is bendable between a substantially straight shape that fits within the recess and a substantially curved shape, wherein the longitudinal housing contains the audio subsystem and includes a flexible material, a controller coupled to the flexible material, the controller to generate one or more control signals that cause the flexible material to complete a bend of the longitudinal housing to the substantially curved shape in response to detachment of the earpiece from the handheld device, and a speaker coupled to the audio subsystem and positioned at an end of the longitudinal housing.

2. The system of claim 1, wherein the controller is to generate the one or more control signals based on one or more of schedule data or context data.

3. The system of claim 1, wherein the controller is to generate the one or more control signals in response to a manual trigger that corresponds to detachment of the earpiece from the handheld device.

4. The system of claim 1, wherein the earpiece further includes one or more pressure sensors to generate one or more feedback signals, and wherein the controller is to discontinue generation of the one or more control signals based on the one or more feedback signals.

5. The system of claim 1, wherein the controller is to initiate a transition of the longitudinal housing from the substantially curved shape to the substantially straight shape in response to a manual trigger that corresponds to removal of the earpiece from an ear.

6. The system of claim 1, wherein the earpiece further includes:

a battery port to receive power; and a charger to supply power to the battery port.

7. The system of claim 1, wherein the flexible material includes one or more of a shape memory alloy, an electroactive polymer or an electromechanical bladder.

8. An earpiece comprising:

an audio subsystem;

a longitudinal housing that is bendable between a substantially straight shape and a substantially curved shape, wherein the longitudinal housing contains the audio subsystem and includes a flexible material;

a controller coupled to the flexible material, the controller to generate one or more control signals that cause the flexible material to automatically complete a bend of the longitudinal housing to the substantially curved shape in response to detachment of the earpiece from a handheld device; and a speaker coupled to the audio subsystem and positioned at an end of the longitudinal housing.

9. The earpiece of claim 8, wherein the controller is to generate the one or more control signals based on one or more of schedule data or context data.

10. The earpiece of claim 8, wherein the controller is to generate the one or more control signals in response to a manual trigger that corresponds to detachment of the earpiece from a handheld device.

11. The earpiece of claim 8, further including one or more pressure sensors to generate one or more feedback signals, wherein the controller is to discontinue generation of the one or more control signals based on the one or more feedback signals.

12. The earpiece of claim 8, wherein the controller is to initiate a transition of the longitudinal housing from the substantially curved shape to the substantially straight shape in response to a manual trigger that corresponds to removal of the earpiece from an ear.

13. The earpiece of claim 8, further including:

a battery port to receive power; and a charger to supply power to the battery port.

14. The earpiece of claim 8, wherein the flexible material includes one or more of a shape memory alloy, an electroactive polymer or an electromechanical bladder.

15. A method comprising:

generating, in response to a first manual trigger that corresponds to detachment of an earpiece from a handheld device, one or more control signals that cause a flexible material of the earpiece to automatically complete a bend of the earpiece to a substantially curved shape; and initiating a transition of the earpiece from the substantially curved shape to the substantially straight shape in response to a second manual trigger that corresponds to removal of the earpiece from an ear.

16. The method of claim 15, wherein the one or more control signals are generated based on one or more of schedule data or context data.

17. The method of claim 15, further including discontinuing generation of the one or more control signals based on one or more feedback signals from one or more pressure sensors of the earpiece.

18. At least one non-transitory computer readable storage medium comprising a set of instructions, which when executed by an earpiece, cause the earpiece to:

generate, in response to a first manual trigger that corresponds to detachment of the earpiece from a handheld device, one or more control signals that cause a flexible material of the earpiece to automatically complete a bend of the earpiece to a substantially curved shape; and initiate a transition of the earpiece from the substantially curved shape to the substantially straight shape in response to a second manual trigger that corresponds to removal of the earpiece from an ear.

19. The at least one non-transitory computer readable storage medium of claim 18, wherein the one or more control signals are to be generated based on one or more of schedule data or context data.

20. The at least one non-transitory computer readable storage medium of claim 18, wherein the instructions, when executed, cause the earpiece to discontinue generation of the one or more control signals based on one or more feedback signals from one or more pressure sensors of the earpiece.

* * * * *